United States Patent [19]

Lorenz

[11] Patent Number: 4,539,449

[45] Date of Patent: Sep. 3, 1985

[54] DISCONNECT SWITCH

[75] Inventor: Dieter Lorenz, Berlin, Fed. Rep. of Germany

[73] Assignee: Siemens Aktiengesellschaft, Munich, Fed. Rep. of Germany

[21] Appl. No.: 396,383

[22] Filed: Jul. 8, 1982

[30] Foreign Application Priority Data

Jul. 10, 1981 [DE] Fed. Rep. of Germany ..... 3127967

[51] Int. Cl.[3] ..... H01N 33/42; H01N 33/12

[52] U.S. Cl. ..... 200/146 R; 200/148 R; 200/148 F

[58] Field of Search ..... 200/148 F, 146 R, 148 A, 200/148 B, 144 R

[56] References Cited

U.S. PATENT DOCUMENTS 1,706,746 3/1929 Rice ..... 200/148 F 3,943,314 3/1976 Frink ..... 200/148 B

OTHER PUBLICATIONS

Siemens Operating Instruction SW 8378—220 "Load Disconnect Switch 3CB, 10kV," pp. 102/1 to 102/3.

*Primary Examiner*—Robert S. Macon

*Attorney, Agent, or Firm*—Kenyon & Kenyon

[57] ABSTRACT

A disconnect switch has a fixed tubular contact and a tubular contact movable into connection with the fixed contact. A movable auxiliary contact within the movable tubular contact can travel into connection with a stationary auxiliary contact on the fixed tubular contact. The switch has short pre-breakdown times at higher voltages and includes a support shaft carried by the movable tubular contact and at least one sleeve which is arranged on the shaft. A pantograph-like connecting member has one end fastened to the sleeve and the other end coupled to the movable auxiliary contact. Elements of a mechanical control device are also fastened to the outside of the sleeve and, in cooperation with fixed extrusions of the outer switchhousing, cause the sleeve to rotate when the movable tubular contact is moved.

7 Claims, 4 Drawing Figures

1
24

T
FIXED AUXILIARY CONTACT
22
4
6
7
23
23
23
19
9
10
14
3
21
8
2
13
11
18
12
15
20
16
17
5
2
8
10

S1
11
18
15
12
S2
6
8
2

25
10
10
2

DISCONNECT SWITCH

BACKGROUND OF THE INVENTION

This invention relates to a disconnect switch which is particularly useful in metal encapsulated switching installations and which has a fixed main tubular contact and a movable main tubular contact which is guided in a stationary outer housing. The movable tubular contact contains an auxiliary contact which is longitudinally movable relative to the movable tubular contact and which makes connection with the stationary contact at a fixed auxiliary contact.

One known disconnect switch of this type (Siemens Operating Instruction SW 8378-220 "Load Disconnect Switch 3CB, 10 kV," pages 102/1 to 102/3 ) is designed as a load disconnect switch (circuit breaker) and has a movable auxiliary contact which acts during disconnect in such a way that an arc is formed only between a so-called sliding contact and a burn-off ring on the contact ring. Because of this arc, gas is liberated from the insulating material of the stationary outer part which escapes from the quenching cup with a strong flow, deionizing the switch gap. In the aforesaid disconnect switch, no quenching device is provided between the stationary main contact and the movable contact tube; the metallic connection via the movable auxiliary contact and the fixed auxiliary contact must therefore be maintained during opening until the switching gap is interrupted after the arc is extinguished. Thereupon, the movable auxiliary contact is pulled out of the fixed auxiliary contact, so that the disconnect switch is visibly separated.

It is an object of the invention to provide a disconnect switch for use at higher voltages in which the large switching gaps necessary in such designs can be obtained without resort to particularly fast operating drives. Here, the term pre-breakdown time is understood to refer to the time during which an arc occurs between the fixed contact and the movable contact when switching on or off.

SUMMARY OF THE INVENTION

To solve this problem, according to the invention, in a disconnect switch of the type described above, at least one sleeve is fastened on a support shaft. One end of a pantograph-like connecting member is attached on the outside circumference of the sleeve. The other end of the connecting member is fastened to the movable auxiliary contact. Elements of a mechanical control device are also fastened on the outside circumference of the sleeve to cause the sleeve to rotate when the main contact moves.

It is an essential advantage of the disconnect switch of the invention that relatively short pre-breakdown times are attained during switching-on as well as switching-off without requiring a special, relatively fast drive for the movable main contact for this purpose. The need for a fast drive is eliminated by providing the disconnect switch with a movable auxiliary contact which is mechanically connected to the movable main contact via a pantograph-like connecting member and the sleeve on the support shaft. The elements of the mechanical control device assure opening of the pantographlike connecting member by rotation of the sleeve on the support shaft after a relatively short travel distance of the movable tubular contact. In this way, the movable auxiliary contact contacts the fixed auxiliary contact considerably earlier than the movable tubular contact reaches the fixed main contact. The disconnect switch of the invention is advantageous also for the switching-off motion because the pantograph-like connecting member closes only when the movable tubular contact has moved relatively far from the fixed tubular contact. Only at this time is the contact between the fixed auxiliary contact and the movable auxiliary contact broken.

In a disconnect switch according to the invention, the support shaft, at least one sleeve, and the pantograph-like connecting member can be placed outside of the main tubular contact. However, to maximize isolation and to obtain a compact design, it is more advantageous to locate the support shaft and the pantograph-like connecting member in the interior of the movable tubular contact. In the latter case, no expensive insulating measures and no openings and/or slots are needed in the tubular contact to establish the mechanical connection between the contact and the movable auxiliary contact which is guided in its interior.

It is advantageous, independently of whether the support shaft and the pantograph-like connecting members are located inside or outside of the contact pin, to provide well-defined conditions of motion by locating the pantograph-like connecting member in a plane which is perpendicular to a plane containing the central axis of the movable auxiliary contact and the axis of the support shaft.

The mechanical control device and the elements attached at the circumference of the sleeve need not be of a particular design so long as, upon movement of the auxiliary contact, they bring about rotary motion of the sleeve for opening the pantograph-like connecting member. To obtain a simple mechanical design, it is advantageous for the elements of the control device to be two stop levers which are attached to the circumference of the sleeve and which are offset relative to each other. When the movable tubular contact moves, each stop lever cooperates with the two extensions attached to the outer housing. Advantageously, the two extensions overlap each other by a predetermined distance in the vicinity of the support shaft, and they extend from the overlap in a direction parallel to the axis away so that initial motion of the movable auxiliary contact is at the same velocity as the movable tubular contact, with the pantograph-like connecting member remaining largely closed. Then, after travel of the movable auxiliary contact for the predetermined distance, a rotary motion of the sleeve occurs, and opening of the pantograph-like connecting member takes place, driven by the elements of the mechanical control device. As a result, the velocity of travel of the movable auxiliary contact is increased considerably and, after a relatively short time, contact is made between it and the fixed auxiliary contact. This event occurs long before the movable tubular contact has arrived at the fixed contact.

In the disconnect switch of the invention, the pantograph-like connecting member can take a number of forms. Thus, it is advantageous for the pantograph-like connecting member to contain a pantograph element which is axially guided on the movable auxiliary contact pin. The axial guidance in this case assures opening and closing of the pantograph element as a result of rotary movement of the sleeve. If this manner of axial guidance is not desired, the pantograph-like connecting member can consist of two elements which form a pantograph. In this case, a second sleeve is provided on the support shaft. The end of one pantograph element is fastened to the outside circumference of one sleeve and the other pantograph element to the outside circumference of the other sleeve.

DETAILED DESCRIPTION OF THE INVENTION

Figures 1, 2, 3, 4:
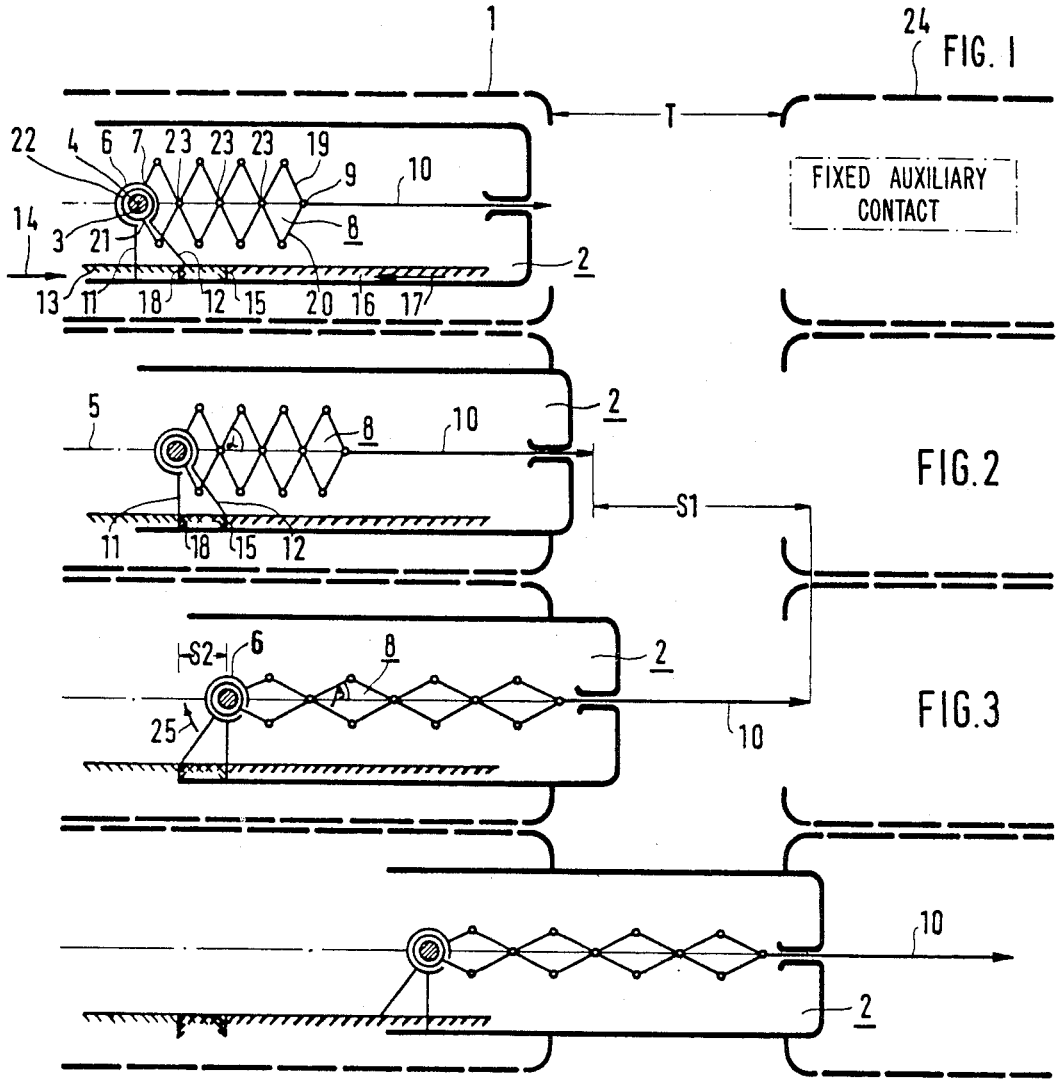
FIGS. 1–4 are schematic representations of a disconnect switch according to the invention in four conditions of operation, from open to closed.

As shown in FIG. 1, movable tubular contact 2 is supported, movable in the longitudinal direction, in stationary tubular outer part 1. Movable contact 2 is provided with support shaft 3, having central axis 4 which goes through longitudinal axis 5 of movable contact 2. Sleeve 6 is rotatably supported on support shaft 3. One end 7 of pantograph-like connecting member 8 is fastened to sleeve 6 and the other end 9 is connected to movable auxiliary contact 10. Movable auxiliary contact 10 is supported and longitudinally movable in movable main contact 2.

First stop lever element 11 and second stop lever element 12 of a mechanical control device are attached on the outside circumference of sleeve 6. Stop levers 11 and 12 are each fastened to sleeve 6 and are axially and circumferentially offset relative to each other. The balance of the mechanical control device is formed by first extension 13 which is fastened to tubular outer part 1 and extends in the direction of arrow 14, ending at the point designated 15. A Second extension 16 extends oppositely in the direction of arrow 17 and ends at the point marked 18. Extensions 13 and 16 therefore overlap in the region between points 18 and 15.

In the illustrated embodiment, pantograph-like connecting member 8 contains not only first pantograph element 19, but also second pantograph element 20. One end 21 of second pantograph element 20 is fastened to the outside circumference of a second sleeve 22. Second sleeve 22 is rotatably mounted on support shaft 3. At its other end, it is connected, like pantograph element 19, to movable auxiliary contact 10. The two pantograph elements 19 and 20 are connected to each other at pivot points 23 where they cross.

Outer housing part 1, along with movable main contact 2 and movable auxiliary contact 10, is placed opposite stationary contact 24 (shown only schematically in the drawings). A fixed auxiliary contact, not shown, is located in stationary contact 24 to receive auxiliary contact pin 10. Stationary outer housing 1 and stationary main contact 24 are spaced apart from each other by switching gap T.

The disconnect switch is represented in its starting position in FIG. 1, being completely open. In this condition, pantograph-like connecting member 8 is largely contracted, with stop lever 11 extending downward, free of extension 16, while second stop lever 12 is braced on extension 13 in the region of overlap between points 18 and 15. Movable tubular contact 2 is housed within stationary outer part 1 and movable auxiliary contact 10 is retracted almost completely into the interior of movable tubular contact 2.

When movable contact 2 is moved in the direction of stationary contact 24 by operating the drive (not shown), first stop lever 11 is carried into contact with the end of extension 16 at point 18. Second stop lever 12 comes to the end of extension 13 at point 15. Meanwhile, up to the position shown in FIG. 2, movable auxiliary contact pin 10 has travelled at essentially the same speed as movable contact 2; pantograph-like connecting member 8 remains largely contracted. When movable contact 2 is moved further forward to the position shown in FIG. 3, sleeve 6 is rotated on support shaft 3, in the direction of arrow 25, since first stop lever 11 now encounters the end of extension 16. Meanwhile second stop lever 12 has passed the end of extension 13 and is free to swing down. During this rotary motion of sleeve 6, pantograph-like connecting member 8 has been extended because end 7 has been carried around on sleeve 6 from its original position towards the longitudinal axis of movable tubular contact 2 (and of movable auxiliary contact 10). Where in the retracted condition (see FIG. 2), pantograph element 19 was at angle $\alpha$, relative to the longitudinal axis of movable auxiliary contact pin 10, it is now at angle $\beta$ (FIG. 3). This relatively small rotary motion of sleeve 6, is thus translated into a substantial motion of pantograph-like connecting member 8 and causes movable auxiliary contact 10 to quickly travel the distance S1, in a shock-like way. Distance S1 can be described by the following equation:

$$S1 = S2 + n \cdot 2r(\cos\beta - \cos\alpha).$$

Where S2 is the distance through which support shaft 3 (or movable tubular contact 2) is displaced during the rotary motion of sleeve 3; this distance is shown in FIG. 3. The length of the section of pantograph elements 19 and 20 from the respective common pivot point 23 to the outside is designated r in the above equation. The number of pantograph sections is designated n. It can be seen from the equation that the movable auxiliary contact travels a considerably longer distance when movable tubular contact 2 is going from the position of FIG. 2 to the position of FIG. 3. This leads to quick establishment of contact between the fixed auxiliary contact and movable auxiliary contact 10, considerably decreasing the pre-breakdown time in the switching-on process. FIG. 4 shows that, after the establishment of contact between movable auxiliary contact 10 and the fixed auxiliary contact, the motion of movable contact 2 and auxiliary contact 10 takes place at substantially the same velocity, with both parts travelling the same distance. In the process, movable auxiliary contact pin 10 penetrates still further into the fixed auxiliary contact and movable contact 2 finally comes into contact with stationary contact 24. The disconnect switch is now closed.

Opening of the disconnect switch takes place in the reverse order. Movable tubular contact 2 moves together with auxiliary contact 10 and is first detached from stationary contact 24. However, auxiliary contact 10 remains in contact with the fixed auxiliary contact for a relatively long time in the course of the switching off process. Only when movable contact 2 has reached the position shown in FIG. 3 is the pantograph-like connecting member 8 retracted, again shock-like, by the reversed rotation of sleeve 3 when stop lever 12 contacts the end of extension 13 at point 15; in the process, auxiliary contact pin 10 is pulled out of the fixed auxiliary contact. Now, however, movable tubular contact 2 is so far away from stationary contact 24 that breakdown can no longer occur. Passing through the condition shown in FIG. 2, movable contact 2 finally returns to the starting position shown in FIG. 1.

What is claimed is:

1. A disconnect switch comprising:

a stationary outer part;

a fixed tubular contact, spaced apart from the stationary outer part;

a fixed auxiliary contact connected to the fixed tubular contact;

a movable tubular contact guided in the stationary outer part and movable into connection with the fixed tubular contact;

a movable auxiliary contact disposed in the movable tubular contact to move into connection with the fixed auxiliary contact;

a support shaft coupled to the movable tubular contact;

a first sleeve rotatably mounted on the support shaft;

a pantograph-like connecting member having one end connected on the outside of the sleeve and the other end connected to the movable auxiliary contact; and a mechanical control mounted on the outside of the sleeve and responsive to motion of the movable tubular contact to rotate the sleeve.

2. A disconnect switch in accordance with claim 1 in which the support shaft and the pantograph-like connecting members are located inside of the movable tubular contact.

3. A disconnect switch in accordance with claim 1 in which the pantograph-like connecting member lies in a plane which is perpendicular to a plane containing both the axis of the movable auxiliary contact and the axis of the support shaft.

4. A disconnect switch in accordance with claim 1 in which the mechanical control comprises:

two stop levers mounted, offset from each other, on the circumference of the sleeve; and two extensions on the stationary outer part, each extension cooperating with one of the stop levers when the movable tubular contact is moved to rotate the sleeve.

5. A disconnect switch in accordance with claim 4 in which the two extensions lie parallel to the axis of the movable tubular contact and overlap each other by a predetermined amount in a region adjacent to the support shaft.

6. A disconnect switch in accordance with claim 1 in which the movable tubular contact comprises an axial guide for the movable auxiliary contact.

7. A disconnect switch in accordance with claim 1 and further comprising:

a second sleeve rotatably mounted on the support shaft, the pantograph-like connecting member comprising first and second cooperating pantograph elements, the end of the first pantograph element fastened to the outside of the first sleeve and the end of the second pantograph element fastened to the outside of the second sleeve.

* * * * *